US011047356B2

(12) United States Patent
Tanaya

(10) Patent No.: US 11,047,356 B2
(45) Date of Patent: Jun. 29, 2021

(54) HIGH FREQUENCY IGNITION DEVICE

(71) Applicant: Mitsubishi Electric Corporation, Tokyo (JP)

(72) Inventor: Kimihiko Tanaya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 156 days.

(21) Appl. No.: 15/691,989

(22) Filed: Aug. 31, 2017

(65) Prior Publication Data

US 2018/0306161 A1 Oct. 25, 2018

(30) Foreign Application Priority Data

Apr. 20, 2017 (JP) ..... JP2017-083340

(51) Int. Cl.
*F02P 3/02* (2006.01)
*F02P 3/01* (2006.01)
(Continued)

(52) U.S. Cl.
CPC ..... *F02P 3/02* (2013.01); *F02P 3/01* (2013.01); *F02P 3/0442* (2013.01); *F02P 7/02* (2013.01);
(Continued)

(58) Field of Classification Search
CPC ..... F02P 3/01; F02P 3/02; F02P 3/055; F02P 7/077; F02P 11/02; F02P 23/04
See application file for complete search history.

(56) References Cited

U.S. PATENT DOCUMENTS 2,376,189 A * 5/1945 Robinson ..... F02P 3/01 123/651
4,592,280 A * 6/1986 Shores ..... F42B 3/188 102/202.14
(Continued)

FOREIGN PATENT DOCUMENTS

JP 57-99272 A 6/1982
JP 5-149228 A 6/1993
(Continued)

OTHER PUBLICATIONS

Electromagnetic Shielding, 2019, Wikipedia; https://en.wikipedia.org/wiki/Electromagnetic_shielding (Year: 2019).*
(Continued)

*Primary Examiner* — Sizo B Vilakazi
*Assistant Examiner* — Anthony L Bacon
(74) *Attorney, Agent, or Firm* — Sughrue Mion, PLLC; Richard C. Turner

(57) ABSTRACT

An ignition device includes: a high frequency power source; a first device having inductance; a second device having capacitance; a discharge GAP; and a shield device which covers a connection portion between the first device and the second device, and is connected to the ground. The high frequency power source supplies AC power to the discharge GAP by using a resonance circuit composed of the first device and the second device, and ignites fuel by discharge plasma generated in the discharge GAP. In the ignition device, the first device, the second device, the connection portion, and the shield device are arranged in the same package and are sealed with an insulating substance.

13 Claims, 4 Drawing Sheets

(51) Int. Cl.

| | |
|---|---|
| ***F02P 23/04*** | (2006.01) |
| ***F02P 9/00*** | (2006.01) |
| ***F02P 15/10*** | (2006.01) |
| ***F02P 7/02*** | (2006.01) |
| ***F02P 3/04*** | (2006.01) |

(52) U.S. Cl.
CPC ..... *F02P 9/007* (2013.01); *F02P 15/10* (2013.01); *F02P 23/04* (2013.01)

(56) References Cited

U.S. PATENT DOCUMENTS

| | | | | |
|---|---|---|---|---|
| 5,426,370 | A | 6/1995 | Miyata et al. | |
| 5,453,694 | A | 9/1995 | Miyata et al. | |
| 5,491,417 | A | 2/1996 | Miyata et al. | |
| 5,543,716 | A | 8/1996 | Miyata et al. | |
| 5,549,795 | A * | 8/1996 | Gregoire | C02F 1/4608 204/164 |
| 5,785,035 | A | 7/1998 | Mitani et al. | |
| 7,099,645 | B2 * | 8/2006 | Shingaki | H03H 7/09 333/204 |
| 2012/0112620 | A1 | 5/2012 | Lykowski et al. | |
| 2014/0116405 | A1 | 5/2014 | Tanaya | |

FOREIGN PATENT DOCUMENTS

| | | | |
|---|---|---|---|
| JP | 7-211433 | A | 8/1995 |
| JP | 2013-542572 | A | 11/2013 |
| JP | 5469229 | B1 | 4/2014 |
| JP | 2014-084836 | A | 5/2014 |

OTHER PUBLICATIONS

LC Circuit, 2019, Wikipedia; https://en.wikipedia.org/wiki/LC_circuit (Year: 2019).*

Why is Cable Capacitance important for Electronic Applications?, 2015, Quabbin Wire & Cable Co., Inc.; https://www.quabbin.com/tech-briefs/why-cable-capacitance-important-electronic-applications (Year: 2015).*

Capacitors, 2017, SparkFun; https://learn.sparkfun.com/tutorials/capacitors/all (Year: 2017).*

Communication dated Apr. 3, 2018, issued by the Japanese Patent Office in counterpart Japanese application No. 2017-083340.

* cited by examiner

HIGH FREQUENCY IGNITION DEVICE

BACKGROUND OF THE INVENTION

1. Field of the Invention

The present invention relates to a high frequency ignition device that mainly uses a plasma discharge by alternative current (AC) power.

2. Description of the Related Art

In recent years, the problem of environmental conservation and fossil fuel depletion has been raised and it becomes an urgent need to deal with these also in automotive industry. As an example for dealing with this, there is a method of dramatically improving the amount of fuel consumption by reducing a pumping loss by the use of exhaust gas recirculation (EGR).

However, burnt, gas, which is exhaust air, is nonflammable and has a larger thermal capacity than that of air; and accordingly, if a large amount of burnt, gas is sucked again, by the EGR, a problem exists in that ignition quality and combustion quality deteriorate.

As one of solutions of this problem, there is proposed an ignition device shown in, for example, Patent Document 1, in which a high frequency discharge is used to ignite in a wide range, whereby a more stable flame kernel can be formed and combustion quality can be more stabilized.

The ignition device disclosed in Patent Document 1 is used, whereby the more stable flame kernel can be formed as compared to a conventional ignition coil and stable combustion can be obtained even when, for example, a great deal of the aforementioned EGR is supplied. Therefore, since a greater deal of the EGR can be supplied and a pumping loss can be reduced as compared to the conventional ignition device by using, for example, the ignition device disclosed in Patent Document 1, there can be obtained an internal combustion engine that can dramatically improve the amount of fuel consumption, Patent Document 1: Japanese Patent Registration No. 5469229

The ignition device disclosed in Patent Document 1 conducts a high frequency current supplied from a high frequency power source; and a capacitor and an inductor, which are connected in series with each other and constitute a band pass filter for blocking a high voltage generated in a secondary coil, are arranged in the same package as a primary coil, and the secondary coil.

In the ignition device disclosed in Patent Document 1, when dielectric breakdown is caused between main plug gaps of an ignition plug, or when the high frequency power source causes the high frequency current to flow into a spark discharge path generated between the main plug gaps of the ignition plug, an extremely high AC voltage is generated in a path through which the capacitor and the inductor are connected.

In the ignition device disclosed in Patent Document 1, in order to prevent, the occurrence of a spark due to the high voltage, the capacitor and the inductor are subjected to insulation treatment by filling of epoxy material or the like, together with the primary coil and the secondary coil.

Although the occurrence of the spark or the like between electrodes of the capacitor, between electrodes of the inductor, or to a contiguous low potential portion can be prevented, the AC high voltage causes a corona discharge on the outside of the case filled with the epoxy material or the like and at a place exposed to a gaseous body such as air.

A polybutylene terephthalate (PBT)-made case or the like causes problems such as corrosion, deterioration in durability, and the like due to the occurrence of the corona discharge.

SUMMARY OF THE INVENTION

The present invention has been made to solve the above described problem and, in a device that generates an AC nigh voltage described above, an object of the present invention is to provide a nigh frequency ignition device which prevents the occurrence of a corona discharge at an unnecessary place and can improve reliability and quality of the device.

A high frequency ignition device according to the present invention includes: a high frequency power source; a first device having inductance; a second device having capacitance; a discharge GAP composed of a high voltage electrode and a grounding electrode; and a shield device which covers a connection portion between the first device and the second device and is connected to the ground. The high frequency power source supplies AC power to the discharge GAP by using a resonance circuit composed of the first device and the second device and thereby igniting fuel by discharge plasma generated in the discharge GAP. In the high frequency ignition device, at least the first device, the second device, the connection portion, and the shield device are arranged in the same package and are sealed with an insulating substance.

According to the nigh frequency ignition device of the present invention, a high energy discharge is efficiently achieved and large discharge plasma is formed by a simple configuration; startability and combustion quality are not impaired even when an ignition plug with a narrow gap is used; and a reduction in weight by highly supercharged downsizing, an improvement in thermal efficiency by improving a compression ratio, and the like can be achieved.

Furthermore, effects exist in that the occurrence of a corona discharge at an unnecessary place is prevented and improvements in reliability and quality of the device can be achieved.

The foregoing and other objects, features, and advantageous effects of the present invention will become more apparent from detailed description in the following embodiments and description in the accompanying drawings.

DETAILED DESCRIPTION OF THE INVENTION

Embodiment 1

Figure 1:
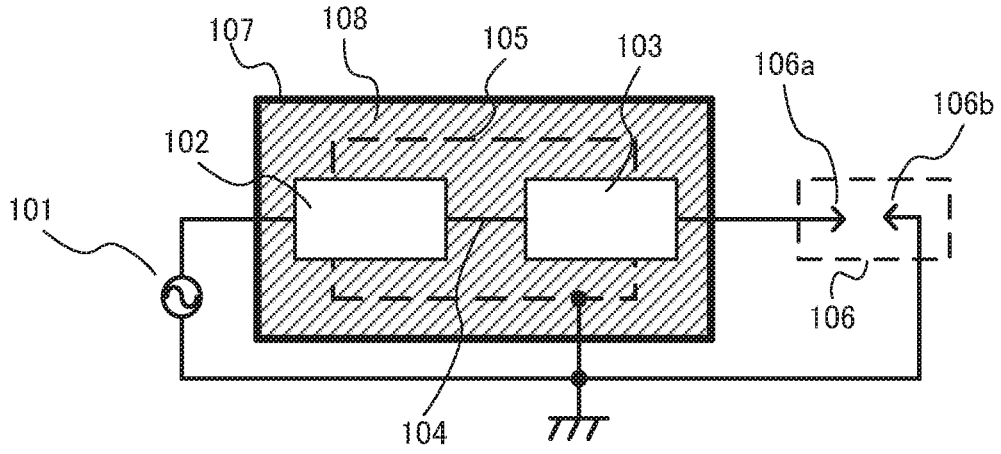
FIG. 1 is a schematic configuration view of a high frequency ignition device according to Embodiment 1 of the present invention.

FIG. 1 is a schematic configuration view of a high frequency ignition device according to Embodiment 1 of the present invention. In FIG. 1, a high frequency ignition device according to Embodiment 1 of the present invention includes: a high frequency power source 101 serving as an energy supply device; a first device 102 having inductance; a second device 103 having capacitance; a shield device 105 which covers a connection portion 104 between the first device 102 and the second device 103 and is connected to the ground; and a discharge GAP 106 composed of a high voltage electrode 106*a* to be connected to the second device 103 and a grounding electrode 106*b* to be connected to the ground. Furthermore, the first device 102, the second device 103, the connection path 104, and the shield device 105 are arranged together in a case 107 and are sealed with an insulating substance 108.

The first device 102 and the second device 103 constitute a resonance circuit; and the high frequency power source 101 outputs AC power near a resonance frequency of the resonance circuit and supplies the AC power to the discharge GAP 106 via the resonance circuit. The high frequency ignition device according to Embodiment 1 forms discharge plasma in the discharge GAP 106 by the AC power and ignites fuel by the discharge plasma.

When the high frequency power source 101 supplies the AC power near the resonance frequency to the resonance circuit, an AC high voltage is generated in the connection path 104 between the first device 102 and the second device 103. The high voltage forms a high electric field between the connection path and ground potential. It is known that when the high electric field is formed in the air, an ion or an electron in the air is accelerated to cause a corona discharge.

The corona discharge acts on the formation of ozone or a bond between molecules; and accordingly, if the corona discharge is generated on the surface of a PBT-made case or the like, the corona discharge causes a harmful effect such as corrosion of the case and deterioration in durability. Therefore, when the PBT-made case or the like is used, the occurrence of the corona discharge on the surface or the like needs to be prevented.

In order to prevent the occurrence of the corona discharge such as this, the high frequency ignition device according to Embodiment 1 of the present invention provides a configuration in which the high electric field is not formed in an air layer by covering the connection path 104, in which the high voltage is generated, between the first device 102 and the second device 103 with the shield device 105 that becomes ground potential and by sealing the connection path 104 and the shield device 105 with the insulation substance 108.

Next, a specific circuit configuration of the high frequency ignition device according to Embodiment 1 of the present invention will be described in detail by using a configuration drawing of FIG. 2. The high frequency ignition device shown in FIG. 2 is mounted on an engine serving as an internal combustion engine of an ordinary vehicle.

Figure 2:
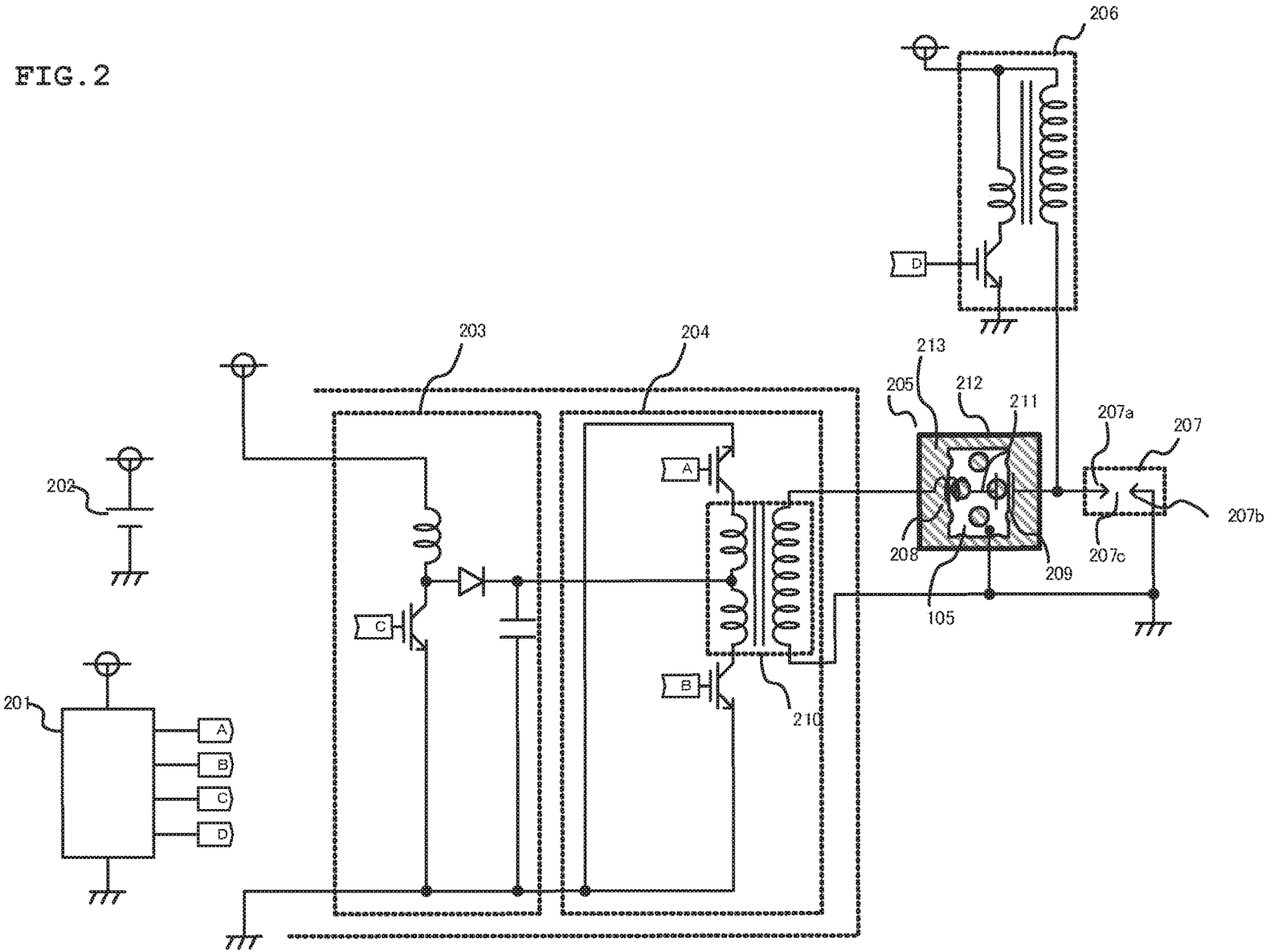
FIG. 2 is a specific circuit configuration diagram of the high frequency ignition device according to Embodiment 1 of the present invention.

In FIG. 2, the high frequency ignition device according to Embodiment 1 of the present invention includes: a control device 201; a battery 202; a DC/DC converter 203; an inverter 204; a resonance device 205; an ignition coil 206; and an ignition plug 207.

The resonance device 205 is composed of an inductor 208, a capacitor 209, and the shield device 105.

The battery 202, the DC/DC converter 203, and the inverter 204 collectively correspond to the high frequency power source 101 of FIG. 1; and, similarly, the inductor 208 corresponds to the first device 102; the capacitor 209 corresponds to the second device 103; and the ignition plug 207 corresponds to the discharge GAP 106.

The battery 202 is for use in vehicles and is charged to approximately 12 volts DC, The inductor 208 is approximately 100 microhenries and the capacitor 209 is approximately 50 picofarads. Then, the inductor 208 and the capacitor 209 form a series resonance circuit and a resonance frequency thereof is approximately 2 megahertz.

The DC/DC converter 203 boosts 12 volts DC of the battery 202 to a voltage of approximately 200 volts DC.

Fuel is supplied to a combustion chamber for operating an engine; and the control device 201 gives instruction so as to output a high voltage to the ignition coil 206 via a path D at an appropriate timing at which a piston becomes near a top dead center, for example, at 20 degrees before the top dead center, and applies the high voltage to a high voltage electrode 207*a* of the ignition plug 207. If the high voltage exceeds a dielectric breakdown voltage, dielectric breakdown occurs between electrodes 207*c* of the ignition plug 207 and a spark discharge path is formed.

When a spark discharge is formed between the electrodes 207*c* of the ignition plug 207, the inverter 204 converts 200 volts DC boosted by the DC/DC converter 203 into 200 volts AC (peak value) near 2 megahertz that is the resonance frequency.

Further, the 200 volts AC is boosted to approximately 1 kilovolt AC by a transformer 210 whose winding turns ratio is approximately 5 times, and then supplied to the spark discharge path between the electrodes 207*c* of the ignition plug 207.

If the AC power is supplied to the spark discharge path, the spark discharge is enhanced and a wide range of extremely strong thermal plasma is formed. By this plasma, the fuel can be ignited even in a fuel state where air/fuel ratio is large, in which ignition cannot be performed by only the spark discharge by the ignition coil 206, or even in a fuel state containing a great deal of EGR.

When AC power is supplied from the inverter 204 to the series resonance circuit, an AC high voltage of not less than several kilovolts is generated in a connection path 211 between the inductor 208 and the capacitor 209.

As described above, an extremely high voltage is applied to the inductor 208 or the capacitor 209. Thus, such a component is arranged in the PBT case or the like and is subjected to insulation treatment by filling of the epoxy material or the like in the conventional device in order to prevent the occurrence of leakage due to the spark.

However, the corona discharge occurred on the surface of the PBT case clue to the high voltage cannot be prevented.

In the high frequency ignition device according to Embodiment 1 of the present invention, the shield device 105 which is connected to the ground potential and covers the connection path 211 between the inductor 208 and the capacitor 209 is arranged in a PBT case 212 together with the inductor 208 and the capacitor 209 and is sealed with epoxy resin 213, whereby the high electric field is not formed in the air layer.

Although the high electric field is formed between the connection path 211 between the inductor 208 and the capacitor 209 and the shield device 105 connected to the ground, the connection path 211 and the shield device 105 are sealed with the epoxy resin 213; and therefore, the ion, the electron, and the like are not sufficiently accelerated and the occurrence of the corona discharge in the case 212 can be prevented. Furthermore, since potential of the shield device 105 lowers to the ground potential, the high voltage is not generated on the surface of the PBT case 212; and therefore, the high electric field is not formed on the outside of the case 212 and the occurrence of the corona discharge can be prevented.

The connection path 211 between the inductor 208 and the capacitor 209 and the shield device 105 are electrically coupled and thereby having a capacitance component. If its capacitance value becomes large and, more particularly in this Embodiment 1, if a capacitance value of the capacitor 209 becomes larger than 50 picofarads, a rate at which the AC power is supplied to the discharge path decreases, the AC power flows out to the ground directly via the capacitance due to the shield device 105, and a loss extremely increases. Thus, this capacitance value needs to be smaller than at least the capacitance value of the device corresponding to the second device 103 so as to be small as much as possible.

In order to decrease the capacitance value composed of the connection path 211 and the shield device 105, for example, the distance between the connection path 211 and shield device 105 is widened as much as possible and/or the epoxy resin 213 to be filled is made small in dielectric constant. Then, in order to reduce the surface area of a metal portion of the shield device 105 as much as possible, it is conceivable to provide a net-like structure or a punching metal structure having a plurality of holes etc.

If the size of the mesh or the size of the hole of the punching metal of the shield device 105 is excessively large, the electric filed leaks out to the outside and the corona discharge is likely to be generated. The electric field strength at the inception of the corona discharge is substantially approximately 5 megavolts/meter under circumstances of atmospheric pressure air. Atmospheric pressure variation or the like is taken into account for this electric field strength, and the size of the hole to be formed in the metal and the structure of the mesh are adjusted with a margin so that the electric field strength to be leaked outside the case is not more than 4 megavolts/meter.

As described above, according to Embodiment 1 of the present invention, the portion at which the AC high voltage is generated and the shield device, which covers the portion at which the AC high voltage is generated and is connected to the ground, are arranged together in the case and are sealed with the insulation substance, so that the high electric field is not formed in the air layer and the high electric field is not formed on the outside of the case; and therefore, the occurrence of the corona discharge at the inside/outside of the case can be prevented and durability and reliability of the device can be improved.

Furthermore, since the shield device is the net-like structure, power consumption of the high frequency ignition device can be reduced.

Figure 3:
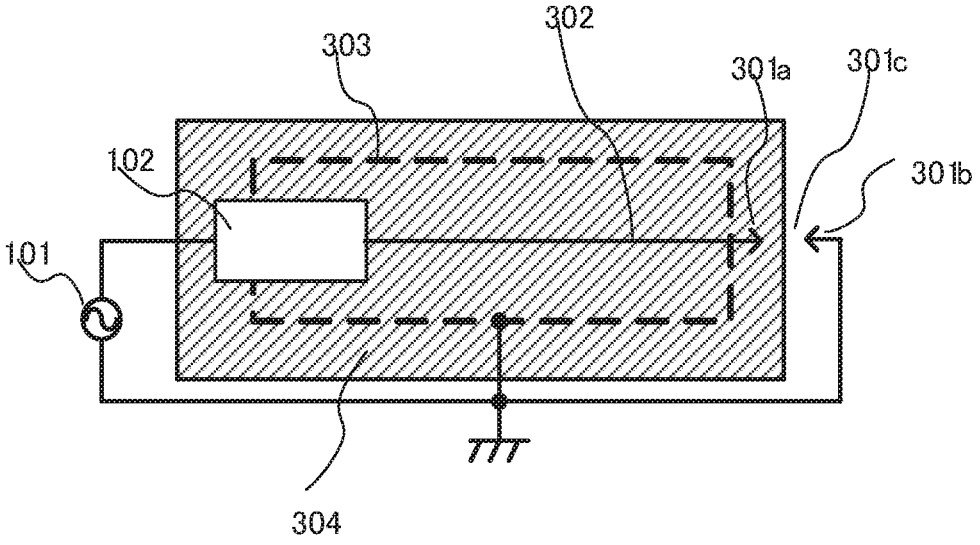
FIG. 3 is a schematic configuration view of a high frequency ignition device according to Embodiment 2 of the present invention.

FIG. 3 is a schematic configuration view of a high frequency ignition device according to Embodiment 2 of the present invention. In FIG. 3, a high frequency ignition device according to Embodiment 2 of the present invention includes: a high frequency power source 101 serving as an energy supply device; a first device 102 having inductance; a high voltage electrode 301*a* to be connected to the first device 102; a grounding electrode 301*b* to be connected to the ground; a discharge GAP 301*c* located between the high voltage electrode 301*a* and the grounding electrode 301*b*; and a shield device 303 which covers a connection path 302 between the first device 102 and the high voltage electrode 301*a* and is connected to the ground.

The connection path 302 and the shield device 303 are electrically coupled and thereby having a capacitance component.

Furthermore, the first device 102, the connection path 302, the shield device 303, and the high voltage electrode 301*a* are sealed together with an insulating substance 304.

An inductance component of the first device 102 and the capacitance component by the connection path 302 and the shield device 303 constitute a resonance circuit; and the high frequency power source 101 outputs AC power near a resonance frequency of the resonance circuit and supplies the AC power to the high voltage electrode 301*a*. The high frequency ignition device according to Embodiment 2 of the present invention forms discharge plasma in the discharge GAP 301*c* by the AC power and ignites fuel by the discharge plasma.

Next, a specific circuit configuration of the high frequency ignition device according to Embodiment 2 of the present invention will be described in detail by using a configuration drawing of FIG. 4. The high frequency ignition device shown in FIG. 4 is mounted on an engine serving as an internal combustion engine of an ordinary vehicle.

Figure 4:
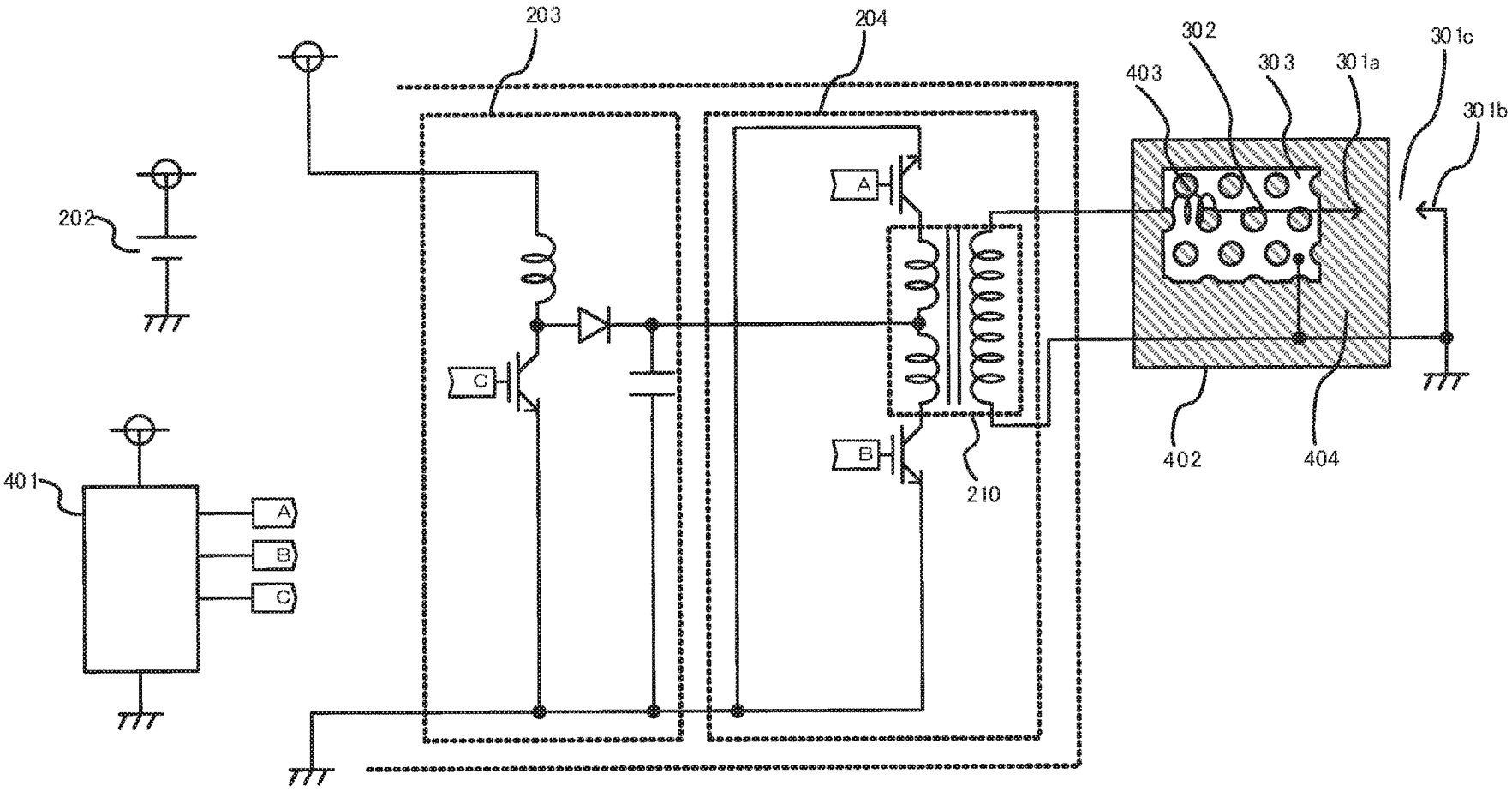
FIG. 4 is a specific circuit configuration diagram of the high frequency ignition device according to Embodiment 2 of the present invention.

In FIG. 4, the high frequency ignition device according to Embodiment 2 of the present invention includes: a control device 401; a battery 202; a DC/DC converter 203; an inverter 204; a resonance device 402; and the grounding electrode 301*b*.

The resonance device 402 includes: an inductor 403; the connection path 302; the shield device 303; and the high voltage electrode 301*a*. Then, these are sealed together and fixed with insulating alumina ceramics 404.

The battery 202, the DC/DC converter 203, and the inverter 204 collectively correspond to the high frequency power source 101 of FIG. 3; and, similarly, the inductor 403 corresponds to the first device 102.

The battery 202 is for use in vehicles and is charged to approximately 12 volts DC. The inductor 403 is approximately 1 henry; a capacitance value composed of the connection path 302 and the shield device 303 is approximately 10 picofarads; and these form a series resonance circuit and a resonance frequency thereof is approximately 50 kilohertz. The DC/DC converter 203 boosts 12 volts DC of the battery 202 to a voltage of approximately 200 volts DC.

Fuel is supplied to a combustion chamber for operating an engine; and the inverter 204 converts 200 volts DC boosted by the DC/DC converter 203 into 200 volts AC (peak value) near 50 kilohertz at an appropriate timing at which a piston becomes near a top dead center, for example, at 20 degrees before the top dead center. Further, the 200 volts AC is boosted to approximately 1 kilovolt AC by a transformer 210 whose winding turns ratio is approximately 5 times, and then supplied to the inductor 403.

When the AC power near the resonance frequency is supplied to the resonance device 402, the supplied AC power is further boosted by a resonance phenomenon to generate an AC high voltage not less than several tens kilovolts at the connection path 302 and the high voltage electrode 301*a*.

When the AC high voltage is supplied to the high voltage electrode 301*a*, a wide range of discharge plasma which is a kind of a corona discharge and is referred to as a dielectric barrier discharge is formed mainly in a direction toward the grounding electrode 301*b* in the vicinity of the discharge GAP 301*c*. By the wide range of the discharge plasma, the fuel can be ignited even in a fuel state large in air/fuel ratio in which ignition cannot be performed by only a spark discharge by an ignition coil (not shown in the drawing) or even in a fuel state containing a great deal of EGR.

If the corona discharge is generated at an unnecessary place, the barrier discharge cannot be generated in the discharge GAP 301*c* or the barrier discharge becomes extremely weak; and accordingly, the fuel cannot be stably ignited or a loss increases and thereby increasing power consumption of the high frequency ignition device.

According to the high frequency ignition device according to Embodiment 2 of the present invention, a portion at which the AC nigh voltage is generated by the resonance phenomenon in the resonance device 402 is covered by the shield device 303 except for the high voltage electrode 301*a*; and therefore, the occurrence of the corona discharge can be prevented at an unnecessary place, except for the vicinity of the discharge GAP 301*c*.

Furthermore, the capacitance value that is electrical coupling capacitance between the connection path 302 and the shield device 303 is decreased as much as possible in order to lower the power consumption of the high frequency ignition device and to efficiently increase a resonance voltage to be applied to the high voltage electrode 301*a*.

More specifically, in the series resonance circuit, if a real resistance value of the resonance circuit is decreased or the capacitance value of the resonance circuit is decreased, it is known that the resonance voltage is efficiently increased. Therefore, in order to decrease the capacitance value that is the electrical coupling capacitance between the connection path 302 and the shield device 303, the distance between the connection path 302 and the shield device 303 is increased and/or a dielectric constant of insulation material to be filled is increased. Then, in order to reduce the size of a metal portion of a shield device 303, the surface area of the metal is reduced by providing a net-like structure or a punching metal structure having a plurality of holes.

If the size of the mesh or the size of the hole of the punching metal of the shield device 303 is excessively large, the electric filed leaks out to the outside and the corona discharge is likely to be generated. The electric field strength at the inception of the corona discharge is substantially approximately 5 megavolts/meter under circumstances of atmospheric pressure air. Atmospheric pressure variation or the like is taken into account for this electric field strength, and the size of the hole to be formed in the metal and the structure of the mesh are adjusted with a margin so that the electric field strength to be leaked outside a case is not more than 4 megavolts/meter.

As described above, according to the high frequency ignition device according to Embodiment 2 of the present invention, since the portion at which the AC high voltage is generated is covered by the shield device to be connected to the ground except for the high voltage electrode, the occurrence of the corona discharge at the unnecessary place can be prevented and the barrier discharge can be efficiently and stably generated in the discharge GAP 301*c*; and therefore, the fuel can be stably ignited even in the fuel state large in air/fuel ratio or even in the fuel state containing a great deal of EGR.

Furthermore, the occurrence of unnecessary corona discharge can be prevented; and therefore, the power consumption of the high frequency ignition device can be reduced.

Incidentally, the present invention can freely combine the respective embodiments and appropriately modify and/or omit the respective embodiments, within the scope of the present invention.

What is claimed is:

1. A high frequency ignition device comprising:

a high frequency power source;

a first device having inductance;

a second device which is connected to said first device and has a first capacitance value, wherein the first device and the second device are configured to form a series resonance circuit, and wherein the series resonance circuit includes a connection portion between said first device and said second device;

a discharge gap composed of a high voltage electrode and a grounding electrode; and a shield device which covers the connection portion, wherein the shield device is connected to a ground and wherein the shield device is configured so that an electric field strength leaked outside the insulating substance does not exceed 4 megavolts/meter, said high frequency power source configured to supply AC power to said discharge gap by using the series resonance circuit and thereby ignite fuel by a discharge plasma generated in said discharge gap, wherein the shield device is configured to limit an electric field strength on an outside of a package, and wherein a second capacitance value associated with electrical coupling between said connection portion and said shield device is configured to not substantially decrease a flow of power to the discharge gap, wherein at least said first device, said second device, said connection portion, and said shield device are arranged in the package, wherein the package is sealed with an insulating substance, and wherein the insulating substance prevents an unnecessary corona associated with the connection portion from weakening the discharge plasma.

2. The high frequency ignition device according to claim 1, wherein said high voltage electrode is also arranged in the package and is sealed with the insulating substance.

3. The high frequency ignition device according to claim 1, wherein the second capacitance value associated with electrical coupling between said connection portion and said shield device is less than the first capacitance value of said second device.

4. The high frequency ignition device according to claim 1, wherein said shield device is connected to the ground and includes a metal plate configured to shield an electric field; and said metal plate is a punched metal structure having a plurality of holes.

5. The high frequency ignition device according to claim 1, wherein said shield device is connected to the ground and includes a metal plate configured to shield an electric field; and said metal plate is a net-like structure having a plurality of holes.

6. The high frequency ignition device of claim 1, wherein the connection portion is surrounded by a first portion of the insulating substance, the shield device is disposed between the first portion of the insulating substance and a second portion of the insulating substance, and wherein the connection portion, the first portion of the insulating substance, and the shield device are within a case.

7. The high frequency ignition device of claim 1, wherein the insulating substance excludes air from the package so as to prevent formation of the unnecessary corona due to a voltage associated with the connection portion, whereby a damage to a case due to the unnecessary corona is prevented.

8. The high frequency ignition device of claim 1, wherein the insulating substance excludes air from a case so as to prevent, outside the discharge gap, a formation of the unnecessary corona, and wherein a corona formed mainly in a direction toward the grounding electrode is promoted, thereby improving the discharge plasma.

9. A high frequency ignition device comprising:

a high frequency power source;

a first device having inductance;

a discharge gap composed of a high voltage electrode and a grounding electrode; and a shield device which covers a connection portion between said first device and said high voltage electrode and is connected to a ground, wherein the shield device is configured to provide a capacitance coupled to the first device, wherein the first device and the capacitance are configured to form a resonance circuit, and wherein the resonance circuit includes the connection portion, and wherein the shield device is configured so that an electric field strength leaked outside the insulating substance does not exceed 4 megavolts/meter, wherein said high frequency power source is configured to supply AC power to said discharge gap by using the resonance circuit and to ignite fuel based on a discharge plasma generated in said discharge gap, wherein the shield device is configured to limit an electric field strength on an outside of a package, and wherein a capacitance value of the shield device is configured to not substantially decrease a flow of power to the discharge gap, wherein at least said first device, said connection portion, and said shield device are arranged in the package, wherein the package is sealed with an insulating substance, and wherein the insulating substance prevents an unnecessary corona associated with the connection portion from weakening the discharge plasma.

10. The high frequency ignition device of claim 9, wherein the connection portion is surrounded by a first portion of the insulating substance, the shield device is disposed between the first portion of the insulating substance and a second portion of the insulating substance, and wherein the connection portion, the first portion of the insulating substance, and the shield device are within a case.

11. A high frequency ignition device comprising:

an ignition plug which includes a first electrode and a second electrode facing each other across a gap, wherein the ignition plug is configured to generate a spark discharge in said gap to ignite a combustible fuel-air mixture in a combustion chamber of an internal combustion engine;

an ignition coil configured to generate a high voltage, and configured to supply the generated high voltage to said first electrode via a high voltage terminal to generate the spark discharge in said gap to form a conductive path in said gap;

a capacitor which is connected to said high voltage terminal of said ignition coil, and is configured to prevent passing of the high voltage;

an inductor which is connected to said capacitor, and constitutes, together with said capacitor, a series resonance circuit, wherein the series resonance circuit is configured to pass only a predetermined frequency component, and wherein the series resonance circuit includes a connection portion between said inductor and said capacitor;

an energy supply device configured to supply AC energy to the conductive path by the spark discharge formed in said gap via said series resonance circuit, wherein a conductive shield device is configured to limit an electric field strength on an outside of a package, and wherein a second capacitance value associated with electrical coupling between said connection portion and said conductive shield device is configured to not substantially decrease a flow of power to the discharge gap; and the conductive shield device, wherein the conductive shield device is configured to shield the connection portion, wherein the conductive shield device is connected to a ground, and wherein the conductive shield device is configured so that an electric field strength leaked outside the insulating substance does not exceed 4 megavolts/meter, wherein said inductor, said capacitor, and said conductive shield device are arranged in the package, wherein the package is sealed with an insulating substance, and wherein the insulating substance prevents an unnecessary corona associated with the connection portion from weakening the spark discharge.

12. The high frequency ignition device according to claim 11, wherein said energy supply device is a high frequency power source.

13. The high frequency ignition device of claim 11, wherein the connection portion is surrounded by a first portion of the insulating substance, the conductive shield device is disposed between the first portion of the insulating substance and a second portion of the insulating substance, and wherein the connection portion, the first portion of the insulating substance, and the conductive shield device are within a case.

* * * * *